US006276786B1

(12) United States Patent
Eida et al.

(10) Patent No.: US 6,276,786 B1
(45) **Date of Patent: *Aug. 21, 2001**

(54) PACKAGING STRUCTURE FOR INK TANK AND INK TANK PACKAGED IN SUCH PACKAGING STRUCTURE

(75) Inventors: Masataka Eida, Kawasaki; Kenji Ookawara, Machida; Hirofumi Kamitakahara, Yamato; Hajime Kishida, Tokyo; Kazuhiro Nakajima, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/807,783

(22) Filed: Feb. 28, 1997

(30) Foreign Application Priority Data

Mar. 1, 1996 (JP) ..... 8-045050
Feb. 13, 1997 (JP) ..... 9-028774

(51) Int. Cl.[7] ..... B41J 2/175
(52) U.S. Cl. ..... 347/86
(58) Field of Search ..... 347/85, 86, 87, 347/108, FOR 86; 206/320, 576, 701, 497

(56) References Cited

U.S. PATENT DOCUMENTS 4,411,918 * 10/1983 Cimino et al. ..... 426/124
5,425,478 6/1995 Kotaki et al. ..... 222/501
5,430,471 7/1995 Nakajima et al. ..... 347/87
5,500,663 3/1996 Ujita et al. ..... 347/86
5,504,511 4/1996 Nakajima et al. ..... 347/86
5,583,549 12/1996 Ujita et al. ..... 347/86
5,589,862 12/1996 Ujita et al. ..... 347/87
5,608,437 3/1997 Iwata et al. ..... 347/86
5,667,071 * 9/1997 Nakagoshi et al. ..... 206/455

FOREIGN PATENT DOCUMENTS 685 340 * 12/1995 (EP) .
07076367 3/1995 (JP) .

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

A packaging structure of the present invention is provided for an ink tank having an ink supply port and an atmosphere communicating port. It has a seal member for sealing the ink supply port, a seal member for sealing the atmosphere communicating port, and an integrated covering member for integrally covering the ink tank having at least these seal members. A partial breakage of the covering member leads to open the atmosphere communicating port at first. Thus, the combination of the packaging structure and the ink tank is constructed so as to open the atmosphere communicating port at first with reliability. It is functionally required at the time of pulling out the ink tank from the package and also at the time of physical distribution without causing an ink leakage, regardless of the shape of the ink tank.

23 Claims, 8 Drawing Sheets

PACKAGING STRUCTURE FOR INK TANK AND INK TANK PACKAGED IN SUCH PACKAGING STRUCTURE

BACKGROUND OF THE INVENTION

1. Field of the Invention

The present invention relates to a packaging structure for an ink tank and an ink tank packaged in such packaging structure, and especially a packaging structure for an operator-changeable ink tank to be used in the form of coupling to an ink-jet head or an intermediate connecting member and an ink tank packaged in such packaging structure.

2. Description of Related Art

In most cases, an operator-changeable ink tank, which is to be used in the form of coupling to an ink-jet head or an intermediate connecting member, comprises two different openings: an ink supply port for supplying ink to the ink-jet head and an atmosphere communicating port for introducing air commensurate in volume with ink consumption.

For avoiding contamination of the ink tank, its user's hands, or the like with an ink leak, a requirement for the ink tank having such two different openings is to prevent leakage of ink therefrom at a physical distribution with reliability and to prevent leakage of ink therefrom at the time of opening a sealed package reliably for replacing the ink tank with new one.

One of the previous attempts to fill the requirement, as disclosed in Japanese Patent Application Laid-open No. 76367/1995, is to provide a packaging member that comprises: an ink cartridge for retaining ink therein and having an opening portion for supplying ink to the outside; and a packaging member for packaging the ink cartridge, in which at least one end of a seal member for sealing the opening portion of the ink cartridge is anchored to an inner surface portion of the packaging member. In that reference, furthermore, a method for opening the sealed package is also disclosed. The method includes the step of tearing a part of the packaging that corresponds to a non-sealed portion of the ink cartridge by utilizing the packaging member itself to bare a part of the ink cartridge and stripping the seal member from the ink cartridge as a result of pulling the ink cartridge out of the packaging member.

For an ink cartridge having two different openings: an ink supply port and an atmosphere communicating port, it has been suggested that a seal member for sealing the openings is shaped so as to have a portion thereof in close proximity to a portion for sealing the ink supply port and the former portion is responsible for reducing peel force to be generated by stripping the seal member from the ink cartridge to open the atmosphere communicating port at fast to prevent an ink leak to be caused by increasing an inner pressure of the ink cartridge at the time of opening the package.

Considering the packaging member and its opening method disclosed in the above Japanese Patent Application Laid-open No. 76367/1995, by the way, it is possible to avoid an ink leak in physical distribution because a part of the packaging that corresponds to a non-sealed portion of the ink tank can be torn by utilizing the packaging member itself to bare a part of the ink tank and the seal member is pulled from the ink tank as a result of pulling the ink tank out of the packaging member. In this case, however, there is no guarantee that the atmosphere communicating port can be opened at fast, resulting in the reliability being insufficient.

Furthermore, a seal member having a portion for reducing a peel force in close proximity to the portion for sealing an ink supply port is only effective on a usage pattern that a single seal member seals upon the ink supply port and an atmosphere communicating port together. Therefore, the range of uses of the seal member is limited to a particular configuration of the ink tank.

SUMMARY OF THE INVENTION

It is, accordingly, an object of the present invention with overcoming the disadvantages in the prior art to provide a packaging structure for an ink tank insuring no ink leakage in physical distribution and also insuring that an atmosphere communicating port is surely opened at first, which is a essential function, when the user opens a package of the ink tank.

More concretely, for consumers using an ink tank of an ink jet recording apparatus or a printer, the above object is especially to provide a packaging structure for the ink tank in which an ink supply port can be opened after opening the atmosphere communicating port of the ink tank without errors when he or she opens the package at the time of replacing the ink tank with new one purchased by the above.

It is a further object of the present invention to provide a cost-effective packaging structure for an ink tank that realizes a printed product of satisfactory quality through the use of an ink-jet recording apparatus, where troubles to be caused by a physical shock or a change in surroundings in physical distribution can be prevented. These troubles include peeling or removing seal members provided on their respective openings (i.e., an ink supply port and an atmosphere communicating port) of an ink tank or an ink-jet cartridge integral with the ink tank.

At the time of replacing the used ink tank with new one, in other words, an opening portion of the packaging member is limited to one while other portions remain just as they are, so that the ink supply port is exposed after opening the sealed atmosphere communicating port by tearing the packaging member in a manner that the user does not confuse the sequence of opening the packaging member and performs the correct opening procedure to finally mount the ink tank on the printer's body.

In the present specification, by the way, the term "an ink tank" is not limited within a particular meaning of its words. It stands for all of the tanks or the like having two openings: an ink supply port and an atmosphere communicating port and retaining ink therein to be supplied to an ink-jet head. It may be provided, for example, as the type of ink tank which almost entirely contains a vacuum generating member inside thereof or the so-called direct liquid type of ink tank which is constituted by containing ink directly and further comprising a vacuum generating source in its inside. Alternatively, it may be provided as another type one comprising a portion for storing a negative pressure-generating member in its inside and a portion for only storing ink, in which these portions are adjacent to each other and communicated to each other through a connecting portion in the bottom of the ink tank.

The term "a seal member for sealing an atmosphere communicating port" is used to mean a member that blocks a communication between the atmosphere and the inside of the ink tank up to the time of mounting the ink tank on a printing device; and allows the above communication by removing the member partially or entirely. If a seal member for sealing an atmosphere communicating groove has the effect of the above functions, it could be regarded as one for sealing the atmosphere communicating port.

For accomplishing the foregoing objects, a first aspect of the present invention is to provide a packaging structure for an ink tank having an ink supply port and an atmosphere communicating port, comprising:

an ink supply port seal member for sealing the ink supply port; and an integrated covering member for covering the ink tank, including at least the atmosphere communicating port and the ink supply port seal member, wherein a partial breakage of the covering member leads to open the atmosphere communicating port at first.

According to the first aspect of the invention, leakage of ink in physical distribution can be perfectly prevented because an ink tank is wrapped in a single-piece covering member having at least a sealing member for sealing an atmosphere communicating port and a sealing member for sealing an ink supply port. In addition, it is constructed so as to open the atmosphere communicating port at first as the covering member is broken in part at the time of opening a sealed package. Therefore, there is no chance to accidentally open the ink supply port at first, resulting in the prevention of ink leakage from the ink supply port with reliability. Furthermore, the cost of materials can be reduced because of covering the atmosphere communicating port with the covering member.

Here, the covering member may be a film-shaped member having two sides sandwiching the atmosphere communicating port, and at least one of the sides has an easy-breakage region.

According to the above configuration, an easily breaking area is formed on at least one of portions of the covering film positioned at either sides of the atmosphere communicating port, so that the atmosphere communicating port can be positively opened at first by breaking the film-shaped covering member.

The covering member may comprise:

easy-breakage regions sandwiching the atmosphere communicating port;and a pull portion extended from a portion sandwiched by the easy-breakage regions of the covering member.

According to the above configuration, a portion of the covering member corresponding to the atmosphere communicating port can be easily torn away by pulling the pull portion, so that the atmosphere communicating port can be more positively opened at first.

A second aspect of the present invention is to provide a packaging structure for an ink tank having an ink supply port and an atmosphere communicating port, comprising:

an ink supply port seal member for sealing the ink supply port;

an atmosphere communicating port seal member for sealing the atmosphere communicating port; and an integrated covering member for covering the ink tank, including at least the ink supply port seal member and the atmosphere communicating port seal member, wherein the atmosphere communicating port is opened at first by partial breakage of the covering member with the atmosphere communicating port seal member being removed.

According to the above configuration, the integrated covering member covers the ink tank, including at least those seal members so that the ink tank can be distributed without causing an ink leak. There is no possibility of opening the ink supply port at first because the packaging structure is constructed that the atmosphere communicating port is opened at first by partially breaking the covering member as the seal member is removed. Thus an ink leak from the ink supply port can be positively prevented.

Here, the atmosphere communicating port seal member may be a film-shaped member and bonded to the ink tank by a heat-sealing or an adhesive.

According to the above configuration, the atmosphere communicating port can be tightly sealed. In addition, the film can be easily removed by pulling it away.

The atmosphere communicating port seal member may comprise a pull portion extending over the covering member, while the covering member has an easy-breakage region formed on at least one of positions corresponding to both edge portions of the atmosphere communicating port seal member.

According to the above configuration, the pull portion can be easily recognized, so that the trouble of confusing other portion with the pull portion can be avoided. By pulling the pull portion, furthermore, a portion of the covering member that corresponds to the seal member for sealing the atmosphere communicating port is easily torn away. Thus, the atmosphere communicating port can be opened more positively at first because of easily removing of the seal member for sealing the atmosphere communicating port.

The covering member may be a heat-shrinkable film.

According to the above configuration, the covering member covers the ink tank without any undesired space between them, so that there is no possibility of accidentally inserting a finger into the space. Therefore, the accidental opening of the ink supply port at first can be positively prevented.

The easy-breakage region may be a perforated tear-off line.

According to the above configuration, the direction of breaking the covering member can be easily determined. In addition, the formation of the breaking area can be easily performed.

The covering member may have different shrinkage factors between at a portion which is positioned so as to correspond to at least the atmosphere communicating port seal member and at a remaining portion.

According to the above configuration, a portion of heat shrinkable film where the easily breakable region is formed can be positioned with respect to the seal member for sealing the atmosphere communicating port. Therefore, it can be easily adjusted.

The atmosphere communicating port seal member and the covering member may be bonded together at least at one part with a predetermined bonding strength.

According to the above configuration, the covering member can be removed at the time of removing the atmosphere communicating port seal member for sealing, resulting in easy breakage of the easily breakable region.

The predetermined bonding strength may be greater than a breakage strength of the easy-breakage region of the covering member.

According to the above configuration, the atmosphere communicating port seal member can be removed, while the covering member is pulled into pieces at first with reliability.

The pull portion may be a portion to be picked up by fingers and has a mark visible to the naked eye.

The covering member may be translucent, opaque, or partially opaque, so that a portion covered with the covering member is difficult to observe or invisible from outside.

According to the above configuration, the atmosphere communicating port seal member and the seal member for sealing the ink supply port are almost hidden from view except the pull portion of the atmosphere communicating port seal member, so that the ink supply port cannot be opened at first by mistake.

A third aspect of the present invention is to provide a packaging structure for a polyhedron ink tank having an ink supply port on one side thereof and an atmosphere communicating groove on another side thereof, comprising:

an ink supply port seal member for sealing the ink supply port;

an atmosphere communicating groove seal member for sealing the atmosphere communicating groove; and an integrated covering member for covering the ink tank, including at least the ink supply port seal member and the atmosphere communicating groove seal member, wherein an end portion of the atmosphere communicating groove is opened by partial breakage of the covering member with a part of the atmosphere communicating groove seal member being removed.

According to the above configuration, the integrated covering member covers the ink tank, including at least those seal members so that the ink tank can be distributed without causing ink leakage. There is no possibility of opening the ink supply port at first because the packaging structure is constructed such that a part of the atmosphere communicating groove is opened at first by partially breaking the covering member as the atmosphere communicating groove seal member is removed. Thus ink leakage from the ink supply port can be positively prevented.

The atmosphere communicating groove seal member may be formed with a slit, excluding a portion facing to the atmosphere communicating groove, for easily breaking a portion to be removed at first.

According to the above configuration, it prevents that the seal member for sealing the atmosphere communicating port is removed perfectly in mistake.

The slit may be formed at each of both edge portions of the atmosphere communicating groove seal member.

According to the above configuration, the seal member can be torn off at the desired position because the slits are formed on both edges of the seal member.

One of the slits may be formed on one edge portion of the atmosphere communicating groove seal member as one formed inwardly from the one edge thereof, while the other slit is formed on the other edge portion of the atmosphere communicating groove seal member as one formed outwardly from an inner side thereof and then at least extended over the covering member in a direction along the other edge the atmosphere communicating groove seal member.

A part of the atmosphere communicating groove seal member is removed without remaining the covering member because of breaking the seal member along a slit line. Therefore, the covering member can be perfectly pulled into pieces.

A fourth aspect of the present invention is to provide a packaging structure for an ink tank having an ink supply port and an atmosphere communicating port, comprising:

an ink supply port seal member for sealing the ink supply port; and an integrated covering member for covering the ink tank, including at least the atmosphere communicating port and the ink supply port seal member, wherein a partial breakage of the covering member leads to open the atmosphere communicating port at first, and the covering member is a film-shaped member having a unidirectional easily breakable property.

According to the above configuration, the integrated covering member covers the ink tank, including at least those seal members so that the ink tank can be distributed without causing ink leakage. There is no possibility of opening the ink supply port at first because the packaging structure is constructed such that the atmosphere communicating port is opened at first by partially breaking the covering member as the seal member is removed. Thus ink leakage from the ink supply port can be positively prevented. At the time of opening the package, in addition, it is constructed so that the atmosphere communicating port is opened at first with a partial breakage of the covering member. Furthermore, the covering member is the film-shaped one having the unidirectional breakable property, so that a partial breakage of the covering member is easily performed in the direction followed in the course of the above unidirectional breakable property. It becomes possible to provide the packaging structure more cost effectively because of a simple structure of covering the atmosphere communicating port with the covering member.

Here, the covering member may comprise:

easy-breakage starting portions sandwiching the atmosphere communicating port; and a pull portion extended from a portion sandwiched by the easy-breakage starting portions of the covering member.

According to the above configuration, a portion of the film-shaped covering member corresponding to the atmosphere communicating port can be easily torn off by pulling the pull portion. Therefore, the atmosphere communicating port can be positively opened at first.

A fifth aspect of the present invention is to provide a packaging structure for an ink tank having an ink supply port and an atmosphere communicating port, comprising:

an ink supply port seal member for sealing the ink supply port;

an atmosphere communicating port seal member for sealing the atmosphere communicating port; and an integrated covering member for covering the ink tank, including at least the ink supply port seal member and the atmosphere communicating port seal member, wherein the atmosphere communicating port is opened at first by partial breakage from an easy-breakage starting portion of the covering member with the atmosphere communicating port seal member being removed.

According to the above configuration, the integrated covering member covers the ink tank, including at least those seal members so that the ink tank can be distributed without causing ink leakage. There is no possibility of opening the ink supply port at first because the packaging structure is constructed such that the atmosphere communicating port is opened at first by partially breaking the covering member as the seal member is removed. Thus ink leakage from the ink supply port can be positively prevented.

Here, the atmosphere communicating port seal member may comprise a pull portion extending over the covering member, while the covering member has the easy-breakage starting portion formed on at least one of positions corresponding to both edge portions of the atmosphere communicating port seal member.

According to the above configuration, it is possible to recognize the pull portion at a glance to avoid the trouble of confusing the opening position. In addition, the covering member can be easily pulled into pieces with a removal of the atmosphere communicating port seal member by pulling the pull portion.

The easy-breakage starting portion may be only formed on the side of the pull portion extending from the atmosphere communicating port seal member.

According to the above configuration, on the other side of the film-shaped covering member (i.e., not the pull side thereof) is provided without any processed regions, so that it is very difficult to remove the covering member from this side. Therefore, a removal of the film-shaped covering member from the side of without having the pull portion can be positively prevented. If the film-shaped covering member is partially removed from the side of without having the pull portion, the atmosphere communicating port cannot be opened appropriately.

Accordingly, the film-shaped covering member is only removed from the side of having the pull portion, so that the atmosphere communicating port can be positively opened at first. By the way, the easy breakage starting portion may be a notch or the like, so that the film-shaped covering member can be processed without any difficulties.

The covering member may be a heat shrinkable film having a uniaxial easily breakable property.

According to the above configuration, the covering member covers the ink tank without any undesired space between them, so that there is no possibility of inserting a finger accidentally into the space. Therefore, the accidental opening of the ink supply port at first can be positively prevented. Furthermore, the breaking direction can be defined with reliability because of using the heat-shrinkage film having the uniaxial breakable property.

The direction of an easily breakable axis of the covering member may be arranged in parallel to a direction of peeling the atmosphere communicating port seal member.

According to the above configuration, a direction of the easily breakable axis of the heat-shrinkage film having the uniaxial breakable property is arranged almost in parallel to a direction of peeling the seal member for sealing the atmosphere communicating port. Therefore, the covering member can be easily pulled into pieces as the above seal member is peeled off. A positioning mechanism of the device for placing the covering member made of the heat-shrinkage film having the uniaxial breakable property onto the ink tank can be simplified.

The easy-breakage starting portion may be a notch formed on an edge of the covering member.

The covering member may have different shrinkage factors with respect to an axis parallel to the direction of peeling the atmosphere communicating port seal member and with respect to an axis perpendicular to the direction of peeling the atmosphere communicating port seal member, respectively.

The shrinkage factors of the covering member may satisfy a relationship represented by: $Y>X$, where Y denotes a shrinkage factor of the covering member with respect to an axis perpendicular to the direction of peeling the atmosphere communicating port seal member; and X denotes a shrinkage factor of the covering member with respect to an axis parallel to the direction of peeling the atmosphere communicating port seal member.

The atmosphere communicating port seal member and the covering member may be bonded together at least at one part thereof with a predetermined bonding strength which is higher than a breakage strength of the covering member.

According to the above configuration, the film-shaped covering member can be placed on the ink tank more precisely.

At least a part of the covering member may be provided as an opaque portion and at least the ink supply port seal member is concealed by the opaque portion.

According to the above configuration, the pull portion catches the eyes of the user at first because of hiding the ink supply port seal member. By forming a transparent portion on the film-shaped covering member, a color of ink can be recognized through the covering member.

DESCRIPTION OF THE PREFERRED EMBODIMENT

The present invention will now be described more fully hereinafter with reference to the accompanying drawings.

One of preferred embodiments of the invention will be described with reference to FIGS. 1 and 2.

Figure 1:
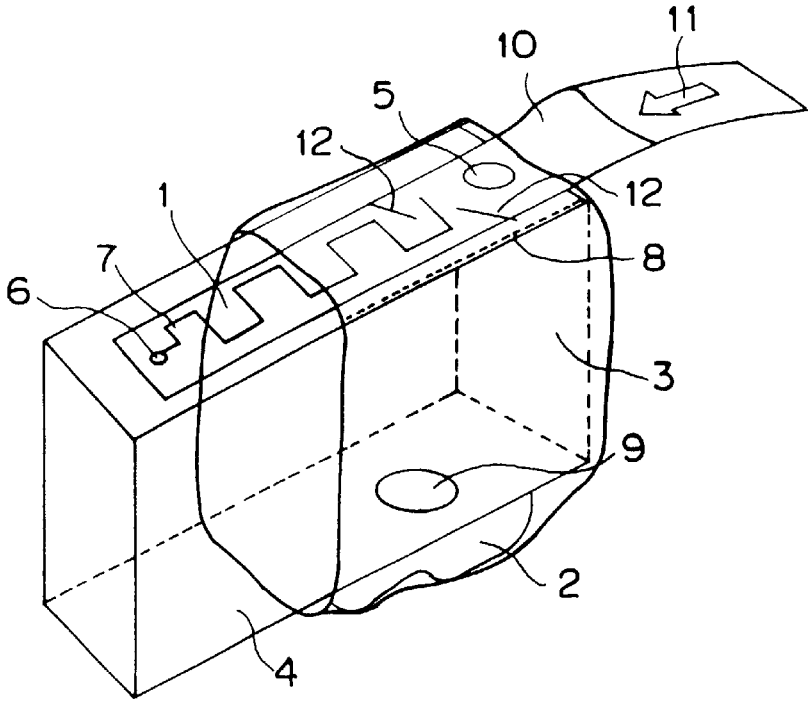
FIG. 1 is a schematic perspective view of one of preferred embodiments of the present invention, in which a ventilating hole 6, an atmosphere communicating groove 7, an adhesive 5, and the like are visually illustrated for the sake of explanation in spite that they are hidden generally behind an atmosphere communicating groove seal member 1 and a covering member 3.
Figure 2:
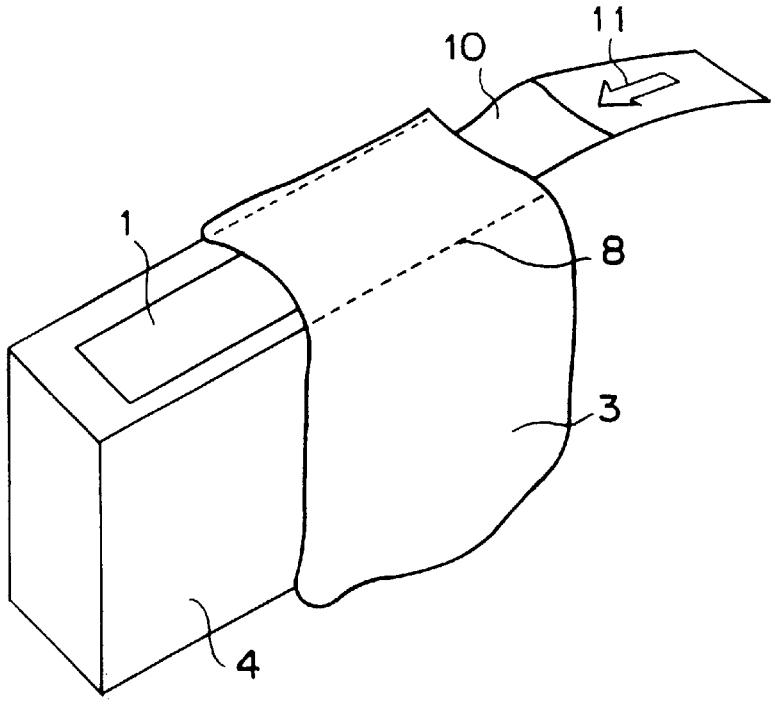
FIG. 2 is a schematic perspective view of one of preferred embodiments of the present invention.

FIG. 1 is a diagrammatic illustration of a preferred embodiment of the present invention and FIG. 2 is an external view of the preferred embodiment shown in FIG. 1.

An ink tank 4 associated with a configuration of the present embodiment is generally in the shape of a rectangular solid and has a top side wall on which a ventilating hole 6 communicating with the inside of the ink tank. The ventilating hole 6 is formed by injection molding, so that it is generally about 1 mm in diameter. Ink evaporation is one of diffusion phenomena and the amount of ink evaporation increases proportionate to an area of a diffusion passage while it decreases inversely with the square of a diffusion length. In the present embodiment, therefore, the top side wall of the ink tank further comprises a groove extending to an area where the ventilating hole 6 is formed. The groove is provided as an atmosphere communicating groove 7 with a zigzag pattern or an intricate pattern (e.g., labyrinth). A film member (hereinafter, referred to as an atmosphere communicating groove seal member 1) covers the long atmosphere communicating groove having an intricate pattern and is affixed to the top wall by an adhesive or a binder to form a long atmosphere communicating passage having an intricate pattern. Hereinafter, the term "the atmosphere communicating groove 7" includes the meaning of the atmosphere communicating passage. Consequently, an amount: of evaporated ink decreases to $1/1000$–$1/10000$ in comparison with that of directly opening the ventilating hole 6 to the atmosphere.

Furthermore, a portion of the atmosphere communicating groove seal member 1, which also functions as an atmosphere communicating port seal member, extends beyond an end face of the ink tank 4 to form a pull portion 10. A part of the pull portion 10 has a marking portion 11 for obviously recognizing the pull 10 itself. For the aid of readily cutting, slits 12 are formed on either edges of a part of the atmosphere communicating groove seal member 1 except the part corresponding to the atmosphere communicating groove 7. The seal member 1 can be torn off along the slits 12 to expose one end of the atmosphere communicating groove 7, resulting in a part of the atmosphere communicating groove 7 becoming communicate with the atmosphere, and thus the atmosphere communicating port (discussed below) becoming opened.

A bottom side wall of the ink tank 4 has an ink supply port 9 which is sealed by a cap 2 provided as an ink supply port sealing member.

On the other hand, a tube-like covering member 3 is positioned around the ink tank 4 having the seal member 1 for sealing the atmosphere communicating groove and the cap 2 for sealing the ink supply port 9.

Furthermore, the covering member 3 is made of a heat shrinkable film, so that it shrinks to a certain size through the addition of heat and tightly holds the atmosphere communicating groove seal member 1, and the cap 2 for sealing the ink supply port to a certain extent. As the covering member 3 is being shrunk by heat, any undesired spaces cannot be formed among the parts of ink tank 4, cap 2, and the like. Thus, it is difficult to insert a user's finger into the space between the parts. Therefore, it is extremely difficult to strip only the covering member 3 off the ink tank 4 resulting in having to be followed the opening procedure described below.

If the covering member 3 is made of an opaque, translucent, or slightly transparent material, as shown in FIG. 2, it is difficult to determine what exists under the covering member 3. In most cases, therefore, the user initially recognizes the pull 10 having the marking portion 11 and then he or she picks up the pull 10 to start the procedure for opening the packaged ink tank 4. Even if the covering member 3 is made of a transparent material, it is difficult to strip off the covering member 3 independently so that the opening procedure would be carried out by initially picking up the pull 10.

The pull 10 and the covering member 3 are positioned in a relative manner as shown in FIG. 1 in which the pull portion 10 is provided as a part of the atmosphere communicating groove seal member 1 while the single covering member 3 is placed on the seal member 1 so as to overlap one another. The pull portion 10 or a portion on the side of the pull portion 10 rather than the side of the cutting slits 12 of the seal member 1 (to be functioned as the seal member for sealing the atmosphere communicating port) may be constructed so as to be connected to the covering means 3 by an adhesive 5 or the like.

Furthermore, the covering member 3 has a perforated tear-off line 8 as an easy-cutting area for the aid of tearing off.

In the configuration of the present embodiment, the perforated tear-off line 8 is formed along each edge of the both shoulder portions of the ink tank 4 in the shape of a rectangular solid, which is corresponded to the both edge portions of the sealing member 1 for sealing the atmosphere communicating groove. However, it is not limited to such configuration. It may be formed at least one shoulder portion for tearing off the covering member 3 at a predetermined position without great difficulty.

Accordingly, the covering member 3 becomes to be torn off along the perforated tear-off line 8 soon after starting to pull the pull portion 10 by the user. If the user continues to pull the pull portion 10, a part of the seal member 1 for the atmosphere communicating groove becomes to be stripped off from the ink tank 4 and then a cutting line runs along the slits 12 to make a communication between a part of the atmosphere communicating groove 7 and the atmosphere and at the last the part of the seal member 1 is finally stripped off. In this case, however, the seal member 1 is adhered with the covering member 3 by an adhesive, so that the covering member 3 can be torn off by further pulling the pull portion 10. Therefore the covering member 3 can be easily torn off at last. After finishing the tear-off procedure, the tube-shaped covering member 3 can be easily separated from the ink tank 4.

At this time, the cap 2 sealing the ink supply port 9 is exposed so that it becomes possible to easily remove the cap 2 as the ink supply port seal member from the ink tank. With this construction, therefore, it is accomplished that the cap is surely opened after the atmosphere communicating groove 7 is opened.

Figure 3:
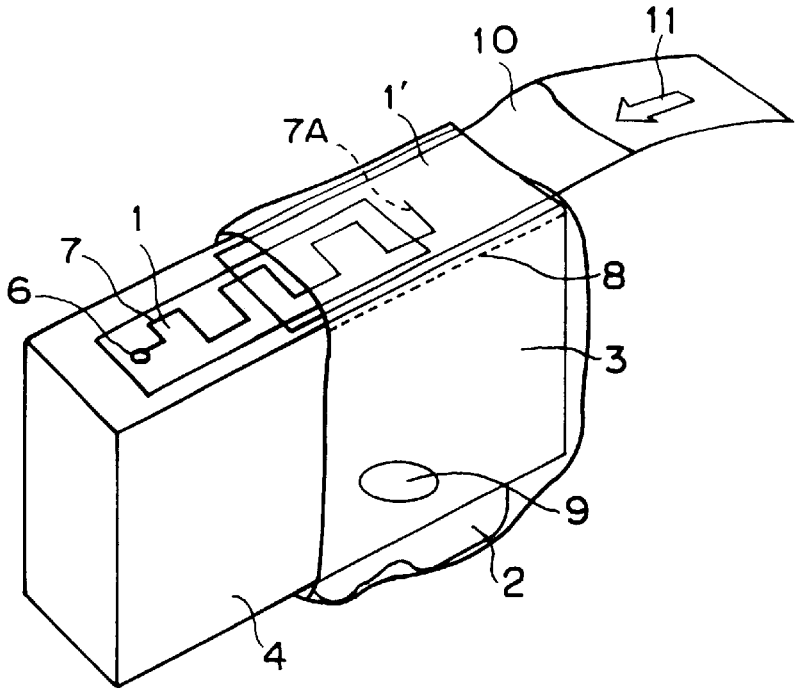
FIG. 3 is a schematic perspective view of another preferred embodiment of the present invention.

Referring now to FIG. 3, another embodiment of the present invention will be described in detail.

The present embodiment has the same structure as that of the first embodiment described above, except that the seal member for sealing the atmosphere communicating groove of the present embodiment is formed by two film-shaped materials while the seal member for sealing the atmosphere communicating groove of the first embodiment is formed by a single film-shaped material. In the present embodiment, that is, the structure of ink tank 4 is the same as that of the first embodiment. Also, an ink supply port seal member 2 is the same as that of the first embodiment. In this embodiment, however, the seal member 1 seals the atmosphere communicating groove 7 except one end portion 7A thereof (hereinafter referred to as an atmosphere communicating port 7A). In addition, a film-shaped seal member 1' for sealing the atmosphere communicating port 7A is adhered on the top wall surface of the ink tank 4.

As in the case of the first embodiment, a part of the atmosphere communicating port seal member 1' directly extends beyond an end face of the ink tank 4 to form a pull portion 10 having a portion provided as a marking portion 11 to clearly indicate itself as the pull.

A covering member 3 of the present embodiment is the same one as that of the first embodiment. It is preferable that the seal member 1' for sealing the atmosphere communicating port extends beyond a width of the tube-like covering member 3.

The present embodiment has been described as the embodiment in which the atmosphere communicating groove 7 is exposed on the top wall of the ink tank but not limited to. The present embodiment may be applicable to an ink tank with a configuration in which an atmosphere communicating passage corresponding to the atmosphere communicating groove 7 is formed in the top wall of the ink tank and an atmosphere communicating port is formed on the top wall so as to communicate with the passage, and also applicable to an ink tank with a configuration in which an atmosphere communicating port is directly formed on the top wall without the passage. As a matter of course, the above configuration eliminates the seal member for sealing the atmosphere communicating groove. Only the seal member for sealing the atmosphere communicating port may be required.

Preferably, a recognition portion such as color patterns, characters or colored layers corresponding to color tones or variations of ink is formed on the covering member 3, and also a recognition display portion 11 such as color patterns, characters or colored layers corresponding to color tones of ink is formed on the pull portion 10 of the atmosphere communicating groove seal member 1 or the atmosphere communicating port seal member 1'. Consequently, color tones, variations, or characteristics of ink stored in the ink tank 4 can be distinguished by the unaided eye.

Another embodiment of the present invention will be described below with reference to FIG. 4.

The present embodiment is provided as an example of a one-piece designed combination of the above seal member for the atmosphere communicating port and the above covering member. That is, an ink tank 4 can be configured in the type that an atmosphere communicating passage corresponding to the above atmosphere communicating groove is formed in the top wall thereof and an atmosphere communicating port is opened on the top wall so as to communicate with the passage, or in the type that an atmosphere communicating port is directly opened on the top wall without having any atmosphere communicating passage. The atmosphere communicating port is shown at 7A like the previous embodiment. Further, a one piece of heat-seal film (hereinafter referred to as a covering member 3') forms a seal member for sealing the atmosphere communicating port and a covering member.

The covering member 3' of the present embodiment is preferably made of a laminated polyethylene film or a laminated film of polyethylene and vinyl acetate copolymer.

In the present embodiment, a top wall of the ink tank 4 is formed separately as a lid 4A and then the lid 4A is fixed to a body of the ink tank 4. At least the lid 4A (i.e., the top wall) is made of polypropylene, so that it can be heat-sealed with a part of the covering member 3' corresponding to a doted area of FIG. 4 after placing the covering member 3' on the ink tank 4 by pulling the end of covering member 3' tight, resulting that the covering member 3' seals the atmosphere communicating port 7A and adheres to the lid 4A.

The covering member 3' has perforated tear-off lines 3 to provide a easy-cutting area for the aid of tearing off. The perforated tear-off lines 8 are formed on both sides of the atmosphere communicating port 7A. It is also possible to form only one perforated tear-off line at least one of these sides. As shown in the figure, a pull portion is extended from a portion sandwiched between the lines 8.

In the figure, by the way, reference numeral 2 denotes a cap as a seal member for sealing the ink supply port as the same one as that of the previous embodiment.

Just as in the case of other embodiments, if the user starts pulling the pull portion 10, the covering member 3' is torn-off along the perforated tear-off lines 8 and stripped off while the atmosphere communicating port 7A is opened. Finally, the covering member 3' is pulled apart into pieces with respect to the whole width of the covering member 3'. After this, it becomes possible to remove the cap 2 provided as the seal member for sealing the ink supply port, so that the order of opening the atmosphere communicating port and the ink supply port can be defined.

In the present embodiment, the space between the ink tank 4 and the covering member 3' could be narrowed by the wrapping procedure using the above laminated film as the covering member 3' and including the steps of wrapping the ink tank 4 having the cap 2 by stretching the ends of the covering member 3' tight and adhering them together by heat-sealing. As a result, there was no possibility of accidentally inserting the user's finger into the space.

Figure 4:
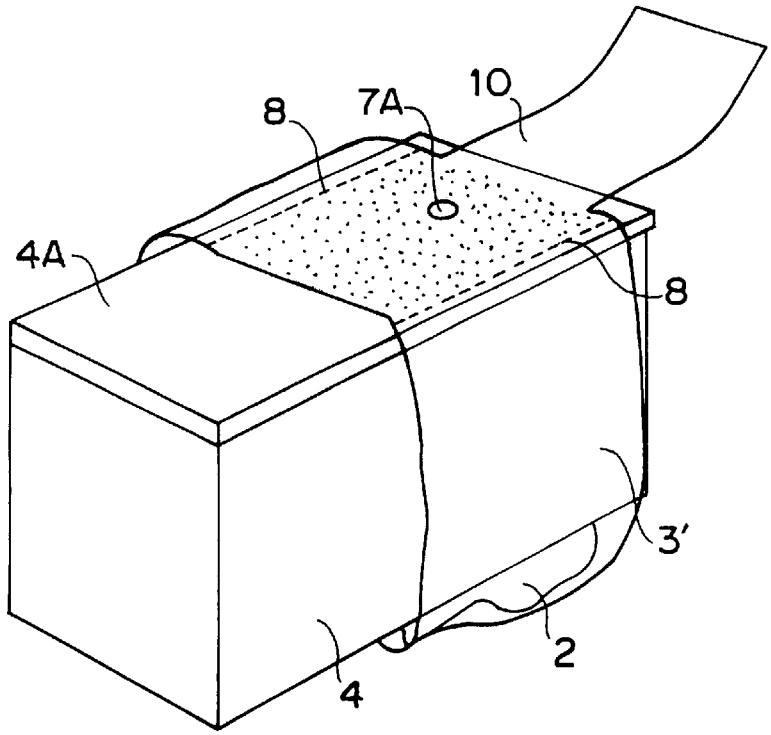
FIG. 4 is a schematic perspective view of another preferred embodiment of the present invention.

The embodiment shown in FIG. 4 may be modified by forming the covering member 3' with a film-shaped material having uniaxial or unidirectional easily breakable properties (i.e., the direction of easily tearing off the covering member 3' is limited to only one direction or along one axis). It means that there is no need to form the easily breakable region such as a perforated tear-off line if the above covering member 3' is positioned so as to arrange the above easily breakable direction parallel to the direction of pulling the pull portion 10.

Furthermore, a V-shaped cut or notch may be formed on both sides of the base of the pull portion 10 as a starting portion of easily tearing-off. In this case, the covering member can be torn into pieces from the starting portion by pulling the pull portion 10 to open the atmosphere communicating port 7A.

Figure 8:
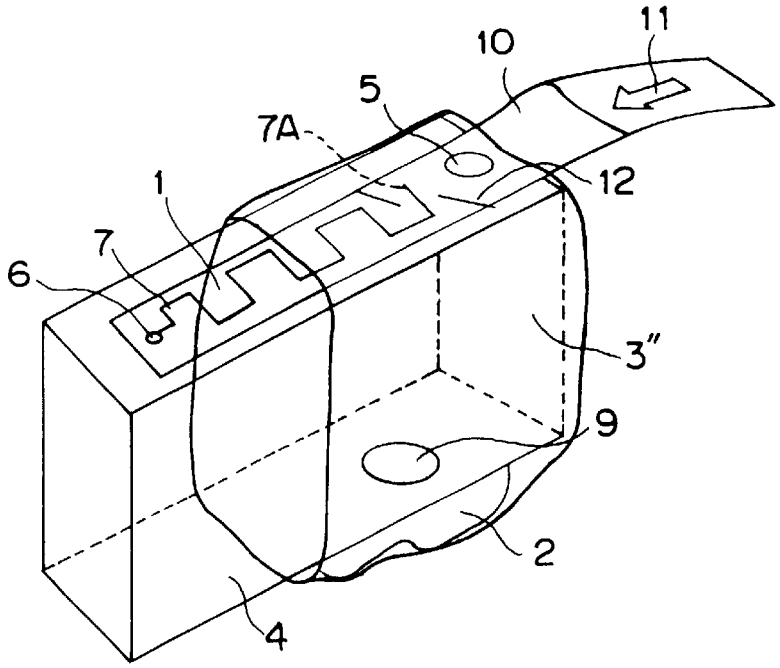
FIG. 8 is a schematic perspective view of another preferred embodiment of the present invention, in which a ventilating hole 6, an atmosphere communicating groove 7, an adhesive 5, and the like are visually illustrated for the sake of explanation in spite that they are hidden generally behind an atmosphere communicating groove seal member 1 and a covering member 3.
Figure 9:
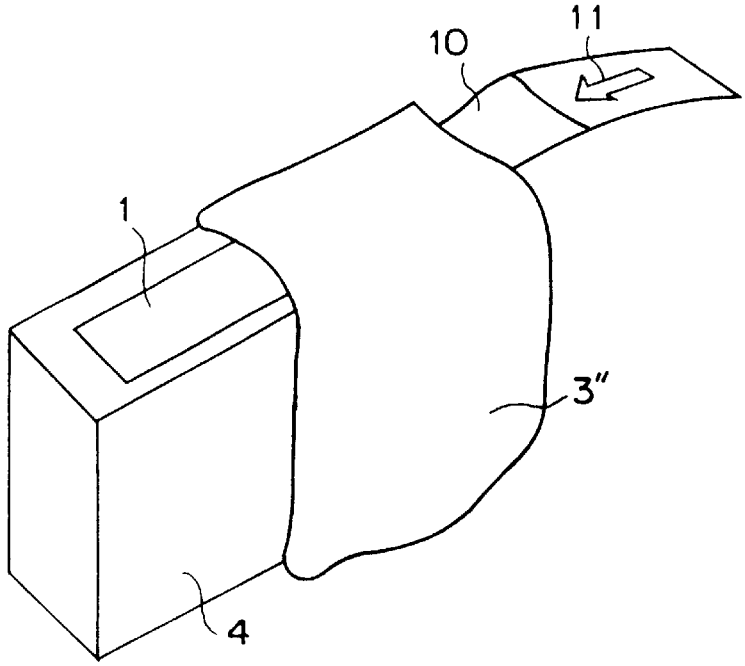
FIG. 9 is a schematic perspective view of the packaging structure for the ink tank shown in FIG. 8.

Referring now to FIGS. 8 and 9, another embodiment of the present invention will be described in detail.

In the present embodiment, a covering member 3" is made of a heat shrinkable film having uniaxial or unidirectional easily breakable properties. Each structure of an ink tank 4 and a seal member 1 for sealing an atmosphere communicating groove to be used in the present embodiment is the same one as that of shown in FIGS. 1 and 2, so that the same reference number denotes the same structural elements to avoid duplicated descriptions. The covering member 3" is adhered to the atmosphere communicating groove seal member 1 by an adhesive in a like manner as that of the previous embodiments described above. In this embodiment, furthermore, the covering member 31" is positioned so as to arrange its easily breakable direction in parallel to the direction of tearing off the atmosphere communicating groove seal member 1. At least one perforated tear-off line as that of the other embodiments described above may be formed on the covering member 3". In this case, however, the covering member 3" having the uniaxial or unidirectional easily breakable properties includes functional characteristics of the perforated tear-off line, so that there is no need to form the perforated tear-off line unless otherwise required.

Accordingly, when the user starts pulling the pull portion 10 to generate a shearing force or a strong tensile force on the side edge of the covering member 3" in the vicinity of both sides of the atmosphere communicating groove seal member 1 breakage of the covering member 3" begins. If the user continues to pull the pull portion 10, a part of the seal member 1 starts dissociating from the ink tank 4 and at some midpoint a cutting line is formed along the slits 12 of the seal member 1 and then the atmosphere communicating port 7A communicates with the atmosphere. At this time, the act of peeling off the seal member 1 is brought to an end. If the user further pulls the pull portion 10, the covering member 3" is further pulled into pieces in the direction along the breakable axis because the pull portion 10 is cemented to the covering member 3" by an adhesive. Consequently, the covering member 3" can be easily torn off at last.

Figure 10:
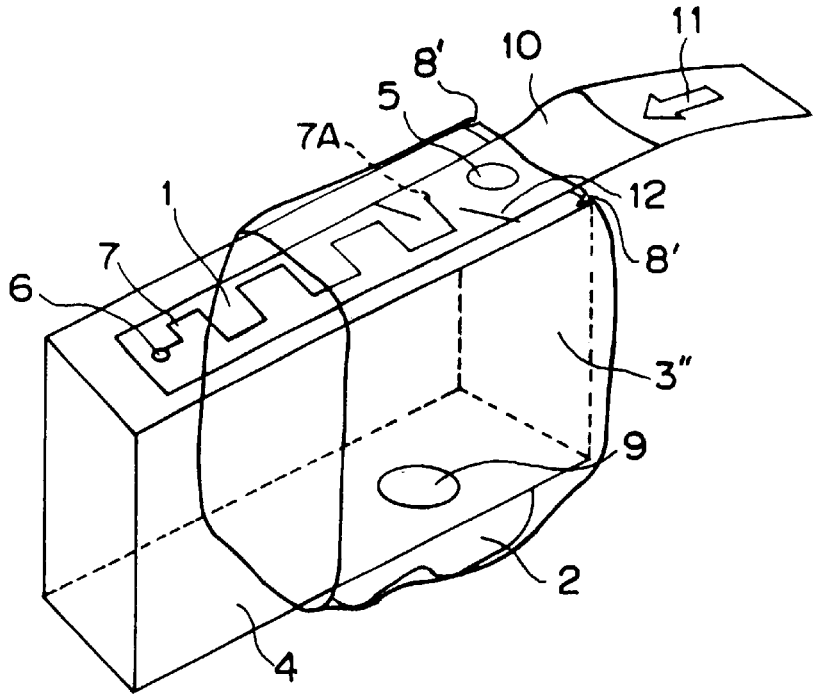
FIG. 10 is a schematic perspective view of another preferred embodiment of the packaging structure for the ink tank, in which several elements are visually illustrated as in the same way as that of FIG. 8.
Figure 11:
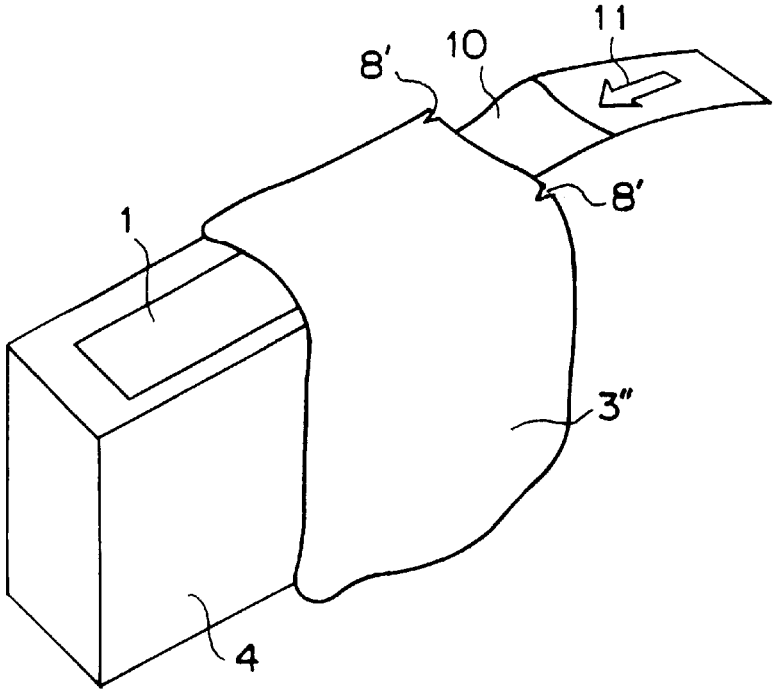
FIG. 11 is a schematic perspective view of the packaging structure for the ink tank shown in FIG. 10.

Referring now to FIGS. 10 and 11, another preferred embodiment of the present invention will be described. For determining a point of tearing off and for easily starting the act thereof, the covering member 3" of the embodiment shown in FIGS. 8 and 9 further comprises easily breakable starting portions such as notches (i.e., V-shaped cuts) 8'. In this embodiment, other elements are the same as those of the embodiments shown in FIGS. 1, 2, and FIGS. 8, 9, so that the same elements have the same reference numerals for omitting their detailed descriptions. The notch 8' is formed on at least one of portions corresponding to both edges of the atmosphere communicating groove seal member 1. It is preferable to form notches on the covering member 3" so as to face to respective edge lines of both shoulders of the ink tank 4 in the shape of a rectangular solid.

According to the above configuration, the covering member 3" having uniaxial easily breakable properties becomes to be torn off at the above easily breakable starting portions (i.e., notches) 8', if the user pulls the pull portion 10. Subsequently, it is further pulled into pieces in the direction parallel to the direction of peeling off the seal member 1. If the user continues to pull the pull portion 10 under such condition, a part of the seal member 1 starts dissociating from the ink tank 4 and at some midpoint a cutting line is formed along the slits 12 of the seal member 1 and then the atmosphere communicating port 7A communicates with the atmosphere. Further continuing to pull, a part of the atmosphere communicating seal member 1 is completely stripped off and, at this time, the act of peeling off the seal member 1 is brought to an end. If the user further pulls the pull portion 10, the covering member 3" is further torn off in the direction along the breakable axis because the pull portion 10 is cemented to the covering member 3" by an adhesive. Consequently, the covering member 3" can be pulled into pieces at last.

The broken covering member 3" can be easily separated from the ink tank 4. By separating the covering member 3" from the ink tank 4, a cap 2 that seals the ink supply port 9 shows up and then the user is able to easily detach the cap 2 from the ink tank 4.

Next, a packaging process for the packaging structure using a heat shrinkable film described above will be described.

Figure 5A:
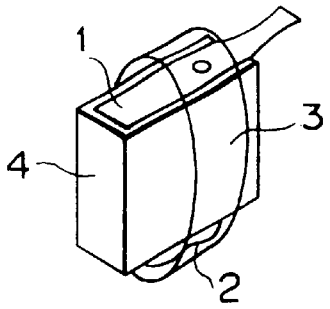
FIGS. 5A–5E are schematic views for illustrating the step of shrinking a covering member to be applied in the present invention.

An ink tank which is packaged by covering the ink tank 4 having the cap 2 and the atmosphere communicating groove seal member 1 or the atmosphere communicating port seal member 1' with the covering member 3 or 3" made of a tubular heat shrinkable film takes a form as shown in FIG. 5A. Perforated tear-off lines 8 are arranged on positions corresponding to the edge lines of the ink tank 4 in the case of the covering member 3. On the other hand, easily breakable starting portions 8' are arranged on positions corresponding to the edge lines of the ink tank 4 in the case of the covering member 3".

Figure 5D:
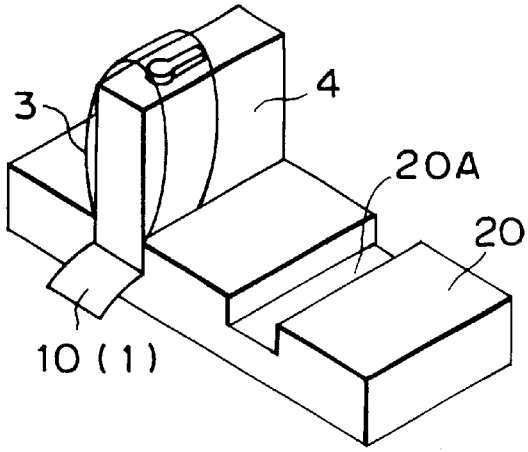
Figure 5B:
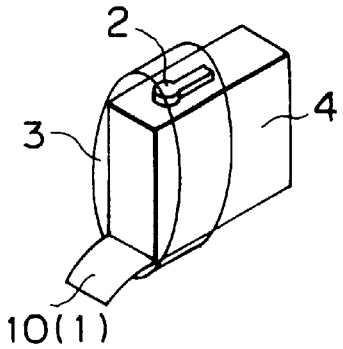
Figure 5E:
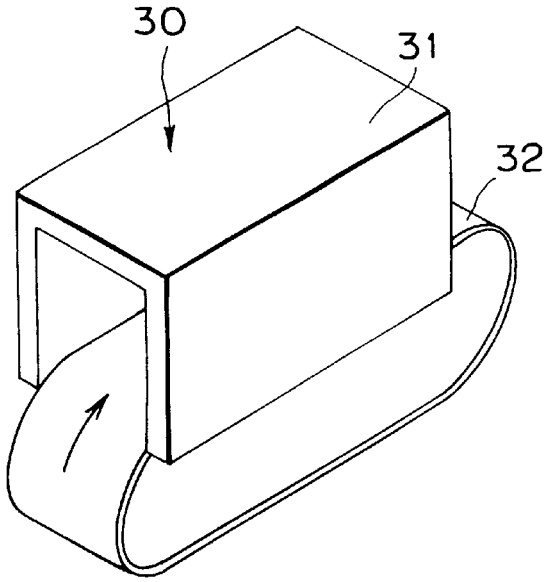
Figure 5C:
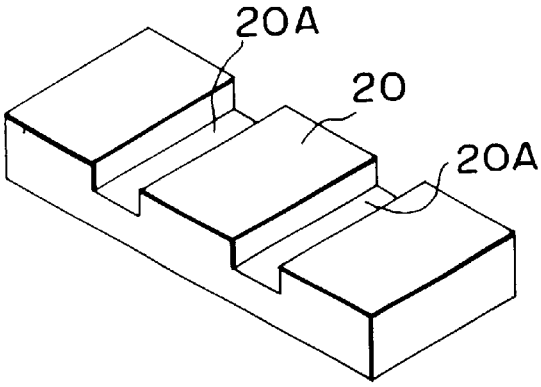

As shown in FIG. 5B, the ink tank 4 under the above condition is turned upside down and then placed in a groove 20A of a metallic transport palette 20 shown in FIG. 5C in an inverted position. That is, a portion of the ink tank 4 that corresponds to the perforated tear-off lines 8 or the breakable starting portions 8" of the covering member 3 or 3" is placed in the groove 20A as shown in FIG. 5D. A width of the groove 20A may be determined in consideration of a width of the ink tank 4 and a thickness of the heat shrinkable film.

The transport pallet 20 under the condition shown in FIG. 5D is loaded on a belt conveyor and passes through a heat shrink furnace 30 to shrink the covering member 3. The heat-shrink process is performed at a temperature of 120–150° C. in the furnace, and also a period of passing the covering member 3 through the furnace 30 is about 10–16 seconds. If the furnace temperature is less than 120° C., the passing period should be prolonged, resulting in decreased productivity. If the furnace temperatures is higher than 150° C., on the other hand, the passing period should be shortened, resulting in difficulty in uniformly shrinking the whole covering member with satisfaction.

Figure 6C:
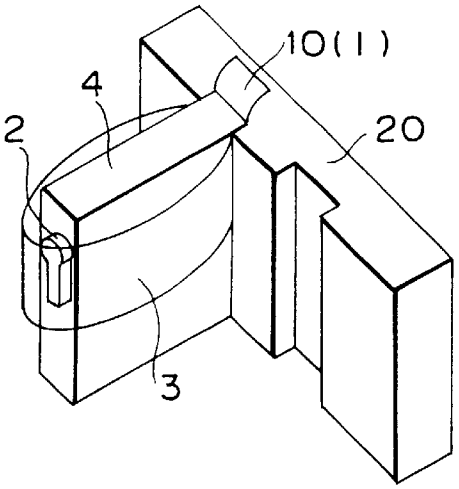
FIGS. 6A–6C are schematic views for illustrate the step of shrinking a covering member to be applied in the present invention.
Figure 6B:
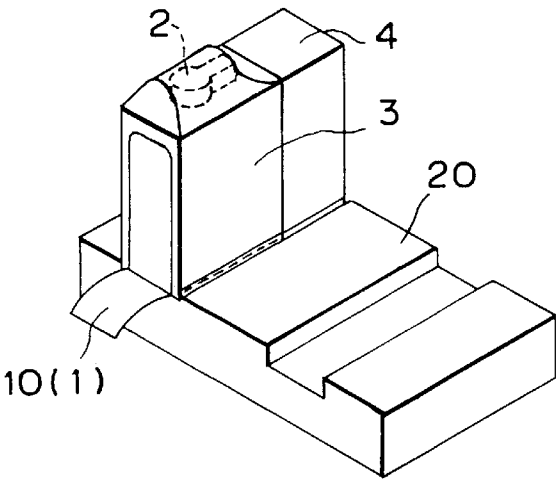
Figure 6A:
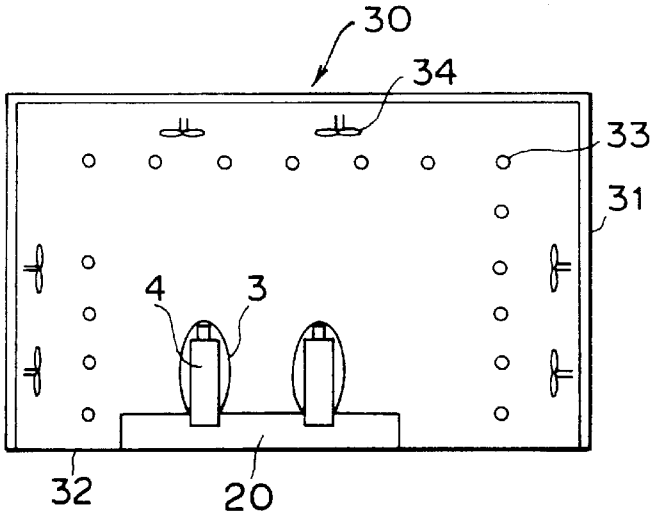

FIG. 6A is a schematic sectional view for illustrating an inner side of the heat shrink furnace 30. The inner side of the furnace 30 is surrounded by furnace's walls 31 and comprises a plurality of electric heating elements 33 to be energized to generate heat. The radiation of heat induces the rise in the temperature of articles in the furnace. In addition, electric fans are arranged in the furnace to exposure the articles to hot air heated by the heating elements 33 so that a temperature of each article is increased.

When the ink tank on the above transport pallet 20 passes through the furnace, the covering member is heated up to the temperature of heat-shrinking right away (about 10 seconds) and then shrinks without delay because it is made of the heat shrinkable film with its low thermal capacity.

FIG. 6B shows the configuration of the combination between the ink tank and the covering member after passing through the furnace. The covering member 3 made of the heat shrinkable film constricted so as to wrap the cap 2 favorably and to avoid an undesired space between the covering member 3 and the ink tank 4.

In the present embodiment, it is noted that the metallic transport pallet 20 is used in the step of passing through the thermal shrink furnace as shown in FIG. 5C.

When a product is subjected to the step of heat-shrink wrapping using the heat shrinkable film, in general, the product is simply wrapped by the film and then charged into the furnace. In this case, however, the way of shrinking of the heat shrinkable film is unpredictable in advance and it results in a displacement of the heat shrinkable film.

According to the present invention, therefore, the metallic transport pallet 20 is used for controlling the heat shrinkage, artificially. As described above, the metallic transport pallet 20 is responsible for preventing heat transfer and restricting the degree of heat shrinkage of all portions concerned for the purpose of: positioning the perforated tear-off line or the breakable starting portion on the position in close proximity to the edge lines of the ink tank 4; preventing the displacement of the covering member 3, 3', or 3"; and preventing the displacement of the region having the perforated tear-off line or the breakable starting portion by heat shrinkage.

By the way, the pallet 20 is not limited to the metallic one. The pallet 20 may be made of one selected from plastic, ceramic, and other materials if the selected material is able to prevent heat transfer and shows the property of heat resistance enough to endure the above temperature.

According to the above configuration, heat radiation and heated air to be supplied from the furnace can be blocked in the groove 20A where the portion of the covering member corresponding to the top wall of the ink tank 4 is positioned. Thus this portion hardly shrinks, resulting in no displacement of the perforated tear-off line or the breakable starting portion by heat shrinkage. On the other hand, other portions including the cap 2 shrink without any limitation and the cap 2 can be tightly held. Accordingly, the displacement of the desired portion can be avoided while the cap 2 can be tightly held by the partially varying a heat shrinkage factor (rate) in the covering member 3, 3', or 3".

For the transportation, the transfer pallet 20 may stand up if the above inverted position would be inconvenient. If the ink tank only contains ink (raw ink), that is not held in an ink-absorbing body, and is formed with a prism mechanism for detecting the remaining ink on the bottom of the ink tank, the above inverted position of the ink tank makes a trouble of attaching air bubbles onto the prism mechanism. It may throw the detection of the remaining ink out of control. Therefore, it cannot be upside down for passing through the furnace.

The notch 8' may be formed by cutting into the covering member 3" after the step of heat shrinkage of the covering member 3" made of the heat shrinkable film to wrap the ink tank 4.

Figure 7:
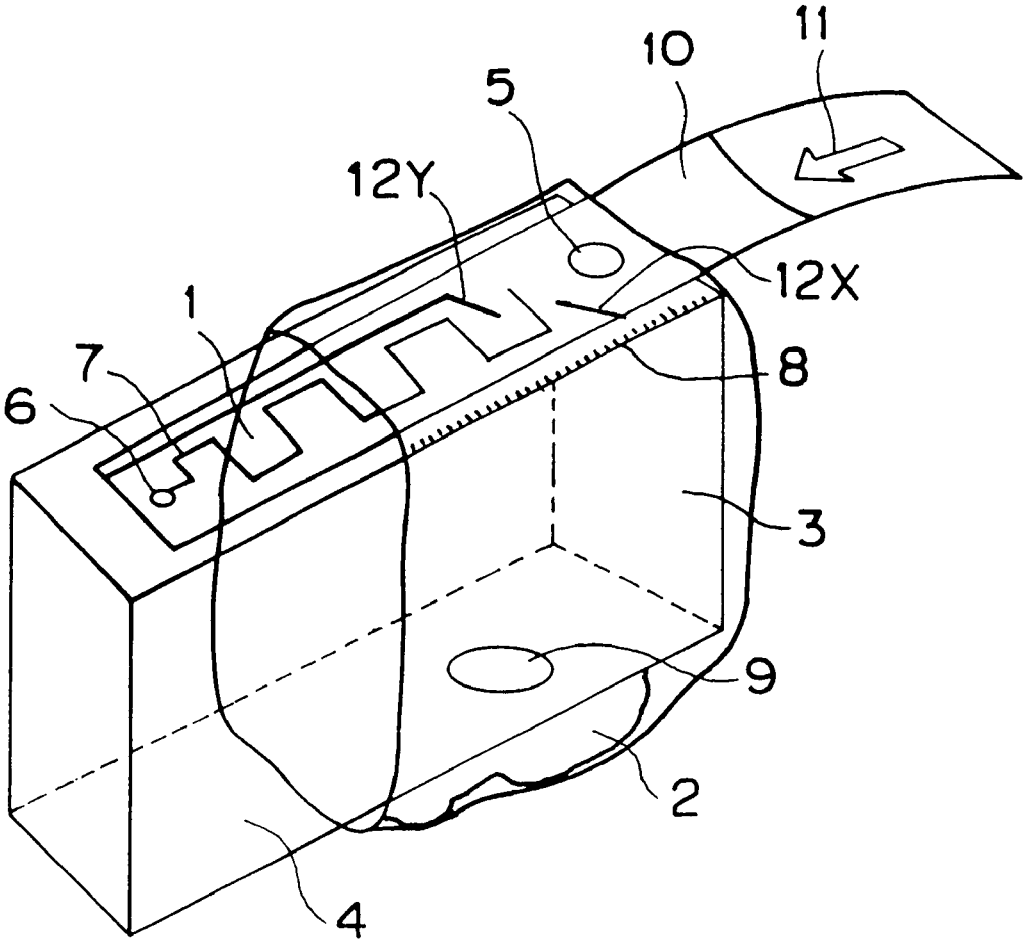
FIG. 7 is a schematic perspective view of another preferred embodiment of the present invention.

Referring now to FIG. 7, furthermore, another embodiment of the present invention will be described.

In the preceding embodiments, slits 12 allowing a portion removed at first to be easily cut off are formed on both sides of the atmosphere communicating groove seal member 1 excluding the atmosphere communicating groove 7. In this embodiment, on the other hand, one of these slits is provided on one edge portion of the seal member 1 as a slit 12X formed inwardly from the outside edge thereof, while the other slit is provided on the other edge portion of the seal member 1 as a slit 12Y having two portions: one formed outwardly from an inner side thereof; and the other formed extendingly along the outside edge of the seal member 1. As shown in the FIG. 7, the slit 12Y extends over at least the covering member 3.

The slits are formed as described above, so that the atmosphere communicating groove seal member 1 can be torn off along the slits under a tensile force at the time of opening by pulling the pull portion 10. Therefore, the covering member 3 can be perfectly pulled to pieces without causing a partial removal of the seal member 1 in addition to remain the covering member 3.

EXAMPLES

Example 1

An ink tank 4 as a sample of the present example was prepared as follows.

The ink tank 4 was prepared in the shape of a rectangular solid (20 mm in width, 80 mm in height, and 100 mm in length) and comprised: a portion for holding a porous member as an ink-preserving body in its inside; and a portion for only holding ink communicating with the former portion trough a communicating port formed on the bottom portion of the ink tank. Then a predetermined amount of ink was introduced into the ink-tank. The ink tank 4 had an ink supply port 9 formed thereon so as to correspond to the portion for holding the porous member. The ink supply port 9 was plugged by a molded-plastic cap 2 having a sealing rubber therein as a seal member for sealing the ink supply port. The top side wall of the ink tank had a ventilating hole 6 and an atmosphere communicating groove 7 which was formed by an injection molding method. Furthermore, a film-shaped seal member 1 for sealing the atmosphere communicating groove was bonded to the ink tank 4 by means of heat-sealing at a temperature of about 160° C. The film-shaped seal member 1 was made of printed laminate structure of aluminized polyester and polyester and polyethylene/polyvinyl acetate copolymer. After bonding the seal member, slits 12 for helping the cutting was formed using a cutting knife.

Then the sample thus formed was covered by a tubular covering member 3 having perforated tear-off lines 8. The perforated tear-off lines 8 were positioned so as to correspond to their respective edge lines of the ink tank 4. A silicon based adhesive was applied as shown in FIG. 1 to make an adhesion between the atmosphere communicating groove seal member 1 and the covering member 3. In this example, the covering member 3 was made of a uniaxially-stretched heat shrinkable polyester film having a thickness of 0.040 mm.

The lines 8 of the covering member 3 were arranged in the direction of opening a pull portion 10, and then the combination of the covering member 3 and the ink tank 4 was placed in a heat-shrink furnace (i.e., a heated air furnace) at 150° C. for 10 seconds to shrink the covering member 3 made of the heat shrinkable film. By this, the space between the covering member 3 and the ink tank 4 became narrow and thus it was difficult to insert a finger into the space.

The obtained sample was packed in a coated board box having its form fitted to the sample, and then it was subjected to a drop test at 90 cm in height with respect to its 1 corner, 3 edges, and 6 faces. It was also subjected to a vibration test for 1 hour with respect to each direction of X, Y, and Z. Furthermore, the sample was subjected to a heat-cycle test with respect to temperatures in the range of −20° C. to 45° C. for 10 cycles.

In each test, the results indicated no breakage of the covering member 3, no disposition of the connection between the covering member 3 and the pull portion 10, and no ink leakage.

An opening test was also performed by pulling the pull portion 10. At an initial period of the opening, a peeling strength of the pull portion 10 was in the range of 1.2 to 2.2 kgf. It was a preferable peeling strength for the opening. The pull portion 10 was further pulled, resulting in the communication between a part of the atmosphere communicating groove 7 and the atmosphere by peeling and cutting the film along the slits 12 of the atmosphere communicating groove seal member.

Furthermore, the pull portion 10 was pulled more and more, the covering member 3 was gradually torn off along the perforated tear-off lines 8 thereof, and finally the covering member 3 was perfectly pulled into pieces to show up the seal member for sealing the ink supply port. Then the ink supply port seal member was removed. Under this condition, no ink leakage from the atmosphere communicating port of the atmosphere communicating groove or the ink supply port was observed.

After those tests, the ink tank was installed in a printer's body to perform a printing test. The results of this test showed that there was no troubles in printing. By the way, it was impossible to install the ink tank on a printer's body when trying to install the ink tank in the state of having the ink supply port seal member 2 without opening the pull portion 10 on the printer's body.

Example 2

An ink tank 4 as a sample of the present example was prepared and tested by the same way as that of the first example with some modifications described below.

The ink tank 4 was prepared in the shape of a rectangular solid (20 mm in width, 80 mm in height, and 100 mm in length) and comprised: a portion for holding a porous member as an ink-preserving body in its inside; and a portion for only holding ink communicating with the former portion trough a communicating port formed on the bottom portion of the ink tank. Then a predetermined amount of ink was introduced into the ink tank. The ink tank 4 had an ink supply port 9 formed thereon so as to correspond to the portion for holding the porous member. In this example, a rubber sheet was fixed on a surface by applying an adhesive so as to seal the ink supply port 9 formed thereon. Furthermore, a covering member 3 covered these structural elements. Consequently, a sample of the present example was obtained. In this case, the covering member 3 covered almost entirely four sides of the ink tank 4.

For supplying ink from the ink tank through the ink supply port, the rubber sheet as the ink supply port seal member may be forcibly peeled off or a tubular material with a hollow such as an injection needle may be inserted into the rubber sheet.

The ink tank thus obtained was installed on a printer's body to perform the printing. Consequently, the printed material is obtained without any problems.

Another sample was prepared by providing a heat-seal film on the outside of the ink supply port 9 and subjecting the film to a heat-seal treatment. The sample was covered with a covering member as in the same way as that of the first example and subjected to a heat shrinkage treatment. The sample was opened by pulling the pull portion of the sample without any problems. After removing the covering member, the ink supply port seal member 2 (i.e., the heat-seal film) was peeled off to finish the opening procedure. On the other hand, the seal member was hardly peeled off if the covering member 3 was left as it was.

The ink tank thus obtained was installed on a printer's body to perform the printing. Consequently, the printing was performed without any problems.

Example 3

An ink tank 4 having the shape of a rectangular solid (20 mm in width, 80 mm in height, and 100 mm in length) similar to the above examples was prepared. The ink tank 4 had an ink-preserving body and ink partially therein.

Next, an atmosphere communicating groove seal member 1 was heat-sealed on the top side wall of the ink tank 4 so as to communicate one end portion of the atmosphere communicating groove 7 (i.e., an atmosphere communicating port 7A) with the atmosphere. Furthermore, an adhesive label 1' was provided as an atmosphere communicating port seal member for completely sealing the atmosphere communicating port 7A overlapping the atmosphere communicating groove seal member 1. Thus the adhesive label 1' and the ink tank 4 are bounded together.

In this case, a length of the adhesive label 1' available for the above bonding was equal to or longer than an opening width of the covering member 3.

A length of the adhesive label 1' included a length of the pull portion 10. For avoiding the pull portion 10 being sticky to the touch, the pull portion 10 was hemmed at its end to put adhesive faces together.

On the ink tank 4 in this condition, a covering member 3 was covered so as to put perforated tear-off lines 8 in the direction of opening. Then the assembly of the ink tank 4 and the covering member 3 was placed in a shrink furnace to heat-shrink the covering member 3. As a result of configuring of the structural elements as described above, it was recognized that the covering member 3 was pulled into pieces along the perforated tear-off lines 8 by stripping atmosphere communicating port seal member 1' composed of the adhesive label away without the need of bonding the seal member 1' to the covering member 3 by an adhesive or the like. Moreover, there was no ink leakage observed.

The ink tank 4 thus obtained was installed on a printer's body. Then the printing was performed without any problems.

Example 4

An ink tank 4 was prepared using a polypropylene resin material and shaped into a rectangular solid (20 mm in width, 80 mm in height, and 100 in length).

An inner structure of the ink tank 4 was separated into two portions: one for holding a porous member as an ink-preserving body; and the other for only storing ink. The latter portion communicates with the former one trough a communicating port formed on the bottom portion of the ink tank. In addition, an ink supply port 9 was formed on the portion for holding the porous member.

During the process of fabricating the ink tank 4, a ventilating hole and an atmosphere communicating groove were formed on its top side wall by injection molding and then the top side wall was bonded to the ink tank 4.

A predetermined amount of ink was introduced into the ink-storing portion of the ink tank 4. A cap 2 was used as a seal member for sealing the ink supply port. Thus, we prepared the ink tank 4 where the ink supply port 9 was being sealed with the cap 2.

Furthermore, an atmosphere communicating groove seal member 1 consisting of a printed aluminized PET film with laminated layers for heat-sealing was heat-sealed on the top side wall of the ink tank 4 at a temperature of about 160° C. to make the ink tank I hermetic. After that, as shown in FIG. 8, cutting-aid slits 12 were formed on predetermined positions of the seal member 1 by a cutter.

The ink tank 4 with the above configuration was covered with a tubular covering member 3" having a uniaxially easily breakable property (Polyolefine based heat shrinkable tube manufactured by Gunze Kobunshi Kogyo Co., Ltd.). For perfectly concealing the cap 2, in this example, a black-colored material with a thickness of 50 $\mu$m was adopted for the covering member 3".

The position of the covering member 3" was adjusted to the predetermined position and then a silicon adhesive 5 was applied on the predetermined position of the atmosphere communicating groove seal member 1 so that the seal member 1 and the covering member 3" were bonded together by hardening the adhesive.

Then the assembly of the ink tank and the covering member was allowed to pass through a shrink tunnel (i.e., a hot air shrinkage device) at 180° C. for 15 seconds to shrink the covering member 3" consisting of a heat-shrinkable film. In general, when the covering member 3" shrinks, it tends to deviate from its original position. For preventing such a deviation, a jig is conventionally used in the step of heat shrinkage. In this example, however, there was no need to use the above jig because according to the packaging structure of the present example the deviation at the time of covering the ink tank 4 or performing the step of heat shrinkage did not cause any problems.

By constructing the combination of the ink tank 4 and the covering member 3 as described above, as shown in FIG. 9 we obtained the ink tank 4 having the packaging structure of the present invention, in which the cap 2 was perfectly concealed while only the pull portion 10 was exposed.

Various tests for evaluating the packaging structure were performed. The ink tank 4 having the package structure of the present invention was packed in a coated board box, and then the box was subjected to a drop test at 90 cm in height with respect to its 1 corner, 3 edges, and 6 faces. It was also subjected to a vibration test for 1 hour with respect to each direction of X, Y, and Z. Furthermore, the sample was subjected to a heat-cycle test with respect to temperatures in the range of −20° C. to 45° C. for 10 cycles.

In each test, the results indicated no breakage of the covering member 3", no separation of the connection between the covering member 3" and the seal member 1 (the pull portion 10), no troubles in the package structure, and no ink leakage.

An opening test was also performed using the ink tank 4 having the packaging structure of the present invention. A peel strength at the time of performing the opening operation by pulling the pull portion 10 (until a part of the atmosphere communicating groove seal member 1 was perfectly peeled off from the ink tank 4) was measured using a push-pull gage. The obtained peel strength was in the range of 1.2 to 2.2 Kgf, which was an appropriate one for the opening.

Furthermore, we verified the opening function of the ink tank 4 having the packaging structure of the present invention. When the opening operation was started by pulling the pull portion 10 of the ink tank 4, cut lines were formed and then the covering member 3" having the uniaxial easily breakable property initiated to be torn to pieces. Simultaneously, a part of the atmosphere communicating groove sealing member 1 became to be peeled off from the ink tank 4. During the progress of peeling the sealing member 1, a cut line run along the slits 12 of the seal member 1, resulting in a part of the atmosphere communicating groove 7 being communicate with the atmosphere. By continuously pulling the pull portion more, a part of the seal member 1 was perfectly peeled off from the ink tank 4 and then the peeling of the seal member 1 for sealing the atmosphere communicating groove was finished at this time. In this case, however, the peeled seal member 1 and the covering member 3" having the uniaxial easily breakable property were bonded by the adhesive 5, so that the tearing of the covering member 3" was further progressed. After all, the covering member 3" was able to be perfectly torn off.

The broken covering member 3" was removed from the ink tank 4 and then naked cap 2 as the ink supply port seal member was detached from the ink supply port. In this condition, any ink leakage from the atmosphere communicating groove 7 communicating to the atmosphere and the ink supply port 9 was not observed.

The ink tank 4 was mounted on a printing device and then a printing test was performed, resulting in a high quality printing being performed without any troubles.

Example 5

An ink tank 4 was prepared using a polypropylene resin material and shaped into a rectangular solid (20 mm in width, 80 mm in height, and 100 in length).

An inner structure of the ink tank 4 was separated into two portions: one for holding a porous member as an ink-preserving body; and the other for only storing ink. The latter portion communicates with the former one trough a communicating port formed on the bottom portion of the ink tank. In addition, an ink supply port 9 was formed on the portion for holding the porous member.

During the process of fabricating the ink tank 4, a ventilating hole and an atmosphere communicating groove were formed on its top side wall by injection molding and then the top side wall was bonded to the ink tank 4.

A predetermined amount of ink was introduced into the ink-storing portion of the ink tank 4. A cap 2 was used as a seal member for sealing the ink supply port. Thus, we prepared the ink tank 4 where the ink supply port 9 was being sealed with the cap 2.

Furthermore, an atmosphere communicating groove seal member 1 consisting of a printed aluminized PET film with laminated layers for head-sealing was heat-sealed on the top side wall of the ink tank 4 at a temperature of about 160° C. to make the ink tank 4 hermetic. After that, as shown in FIG. 8, cutting-aid slits 12 were formed on predetermined positions of the seal member 1 by a cutter.

The ink tank 4 with the above configuration was covered with a tubular covering member 3", which was formed with easy-breakage starting portions 8', with a uniaxial easily breakable property (Polyolefine based heat shrinkable tube manufactured by Gunze Kobunshi Kogyo Co., Ltd.). For perfectly concealing the cap 2, in this example, a black-colored material with a thickness of 50 $\mu$m was adopted for the covering member 3". As a result of performing a breakage test on the film having the uniaxial easily breakable property, it was revealed that only a deviation of the order of 2 mm was observed in spite of peeling the film to the order of 100 mm.

The easy-breakage starting portions 8' were arranged in the positions facing to the respective edge lines of the ink tank 4, and then a silicon adhesive 5 was applied on the predetermined position of the atmosphere communicating groove seal member 1 so that the seal member 1 and the covering member 3" were bonded together by hardening the adhesive. In this example, the easy-breakage starting portions 8' were previously formed on the covering member 3" but not limited to. It is also possible to form the easy-breakage starting positions 8' after shrinking the covering member made of the heat shrinkable film so as to fit to the shape of the ink tank 4.

Then the assembly of the ink tank and the covering member was allowed to pass through a shrink tunnel (i.e., a hot air shrinkage device) at 180° C. for 15 seconds to shrink the covering member 3" consisting of a heat-shrinkable film. In general, when the covering member 3" shrinks, it tends to deviate from its original position. For preventing such a deviation, a jig is conventionally used in the step of heat shrinkage. In this example, however, there was no need to use the above jig because the packaging structure of the present example only required to prevent deviation of two easy-breakage starting portions 8' and also their positions were close to the point of connection between the atmosphere communicating groove seal member 1 and the covering member 3".

By constructing the combination of the ink tank 4 and the covering member 3 as described above, as shown in FIG. 11 we obtained the ink tank 4 having the packaging structure of the present invention, in which the cap 2 was perfectly concealed while only the pull portion 10 was exposed.

Various tests for evaluating the packaging structure were performed. The ink tank 4 having the package structure of the present invention was packed in a coated board box, and then the box was subjected to a drop test at 90 cm in height with respect to its 1 corner, 3 edges, and 6 faces. It was also subjected to a vibration test for 1 hour with respect to each direction of X, Y, and Z. Furthermore, the sample was subjected to a heat-cycle test with respect to temperatures in the range of −20° C. to 45° C. for 10 cycles.

In each test, the results indicated no breakage of the covering member 3", no separation of the connection between the covering member 3" and the seal member 1 (the pull portion 10), no troubles in the package structure, and no ink leakage.

An opening test was also performed using the ink tank 4 having the packaging structure of the present invention. A peel strength at the time of performing the opening operation by pulling the pull portion 10 (until a part of the atmosphere communicating groove seal member 1 was perfectly peeled off from the ink tank 4) was measured using a push-pull gage. The obtained peel strength was in the range of 1.2 to 2.2 Kgf, which was an appropriate one for the opening.

Furthermore, we verified the opening function of the ink tank 4 having the packaging structure of the present invention. When the opening operation was started by pulling the pull portion 10 of the ink tank 4, cut lines were formed and then the covering member 3" having the uniaxial easily breakable property initiated to be torn to pieces. Simultaneously, a part of the atmosphere communicating groove sealing member 1 became to be peeled off from the ink tank 4. During the progress of peeling the sealing member 1, a cut line run along the slits 12 of the seal member 1, resulting in a part of the atmosphere communicating groove 7 being communicate with the atmosphere. By continuously pulling the pull portion more, a part of the seal member 1 was perfectly peeled off from the ink tank 4 and then the peeling of the seal member 1 for sealing the atmosphere communicating groove was finished at this time. In this case, however, the peeled seal member 1 and the covering member 3" having the uniaxial easily breakable property were bonded by the adhesive 5, so that the tearing of the covering member 3" was further progressed. After all, the covering member 3" was able to be perfectly torn off.

The broken covering member 3" was removed from the ink tank 4 and then naked cap 2 as the ink supply port seal member was detached from the ink supply port. In this condition, any ink leakage from the atmosphere communicating groove 7 communicating to the atmosphere and the ink supply port 9 was not observed.

The ink tank 4 was mounted on a printing device and then a printing test was performed, resulting in a high quality printing being performed without any troubles.

Example 6

An ink tank 4 was prepared using a polypropylene resin material and shaped into a rectangular solid (20 mm in width, 80 mm in height, and 100 in length) and subjected to the same process as described in Example 4 including the steps of introducing a predetermined amount of ink into the ink tank 4, sealing an ink supply port 9, and forming cutting-aid slits 12 on the predetermined positions of an atmosphere communicating groove seal member 1 for sealing after placing the seal member 1 on the top wall of the ink tank by heat-sealing.

The ink tank 4 with the above configuration was covered with a tubular covering member 3", which was formed with easy-breakage starting portions 8', with a uniaxial easily breakage property (Polyolefine based heat shrinkable tube manufactured by Gunze Kobunshi Kogyo Co., Ltd.).

Figure 12:
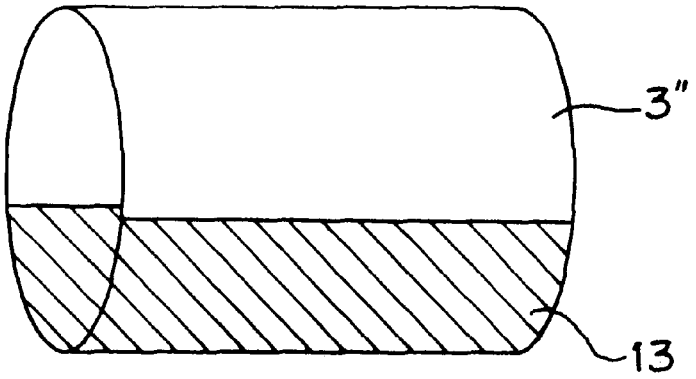
FIG. 12 is a schematic illustration of the covering member to be used in Example 6 in accordance with the present invention.

In this example, the covering member 3" was a natural-colored (i.e., opaque white and semitransparent) material with a thickness of 50 $\mu$m. As a result of performing a breakage test on the film having the uniaxial breakage property, it has been revealed that only a deviation of the order of 2 mm is observed in spite of peeling the film to the order of 100 mm. For fully hiding only the cap 2 provided as a seal member for sealing the ink supply port, as shown in FIG. 12, a part of the covering member 13 was subjected to a masking treatment to form a masked portion 13 (an area enough to cover the cap after shrinking the covering member). A method of the masking treatment includes printing, or two-color printing or two color film laminating at the time of forming the heat-shrinkage tube to apply the comparatively higher cancelable color only on the portion where the masking is being required. In this example, by the way, the masking treatment was performed by gray printing on a part of the covering member 3".

Assuming that the covering member 3 was shrunk, the position of the masked portion 13 was arranged in the position where the cap 2 was hidden. After that, a silicon adhesive was applied on the predetermined position of the atmosphere communicating groove seal member 1 so that the seal member 1 and the covering member 3" were bonded together by hardening the adhesive. The combination of the ink tank and the covering member was allowed to pass through a shrink tunnel (i.e., a hot air shrinkage device) under the same conditions as those of Example 4 to shrink the covering member 3". After shrinking the covering member 3", easy-breakage starting portions 8' were formed on the same positions as those of Example 5.

Figure 13:
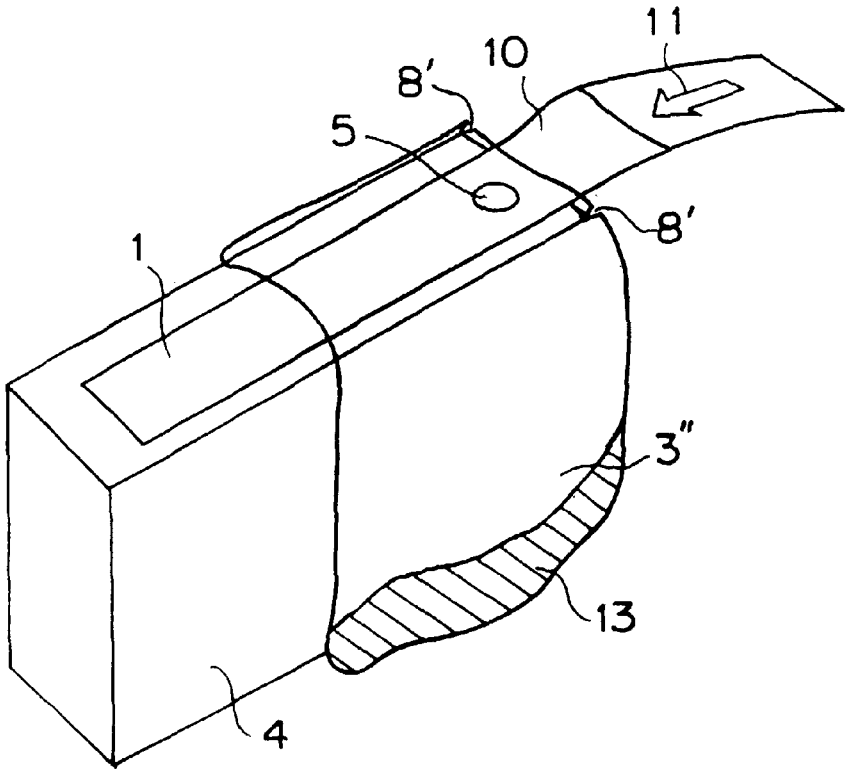
FIG. 13 is a schematic perspective view of the packaging structure for the ink cartridge of Example 6 in accordance with the present invention.

By constructing the combination of the ink tank 4 and the covering member 3" as described above, as shown in FIG. 13, the ink tank 4 having the packaging structure of the present invention, in which the cap 2 was perfectly concealed while only the pull portion 10 was exposed.

Just as in the case of Example 4, various tests for evaluating the packaging structure were performed. The obtained results indicated that there was no troubles of the packaging structure and also there was no ink leakage.

The opening test was also performed by the same way as that of Example 4. The obtained peel strength was in the range of 1.2 to 2.2 Kgf, which was an appropriate one for the opening.

The ink tank 4 was mounted on a printing device and then a printing test was performed, resulting in the high quality printing performed without any troubles.

What is claimed is:

1. A packaging structure for an ink tank, the ink tank having an ink supply port and an atmosphere communicating port, the packaging structure comprising:

an ink supply port seal member for sealing said ink supply port;

an atmosphere communicating port seal member for sealing said atmosphere communicating port; and a covering member completely covering the ink supply port seal member and partially covering the atmosphere communicating port seal member wherein said covering member is made of a heat shrinkable film and is bonded to said atmosphere communicating port seal member.

2. A packaging structure for an ink tank as claimed in claim 1, wherein said covering member has an easy-breakage region such that said covering member is easily opened by utilizing a portion of said atmosphere communicating seal member which is not covered by said covering member, and wherein, after opening of said covering member, said ink supply port seal member can be accessed and opened.

3. A packaging structure for an ink tank as claimed in claim 2, wherein the easy-breakage region is a perforated tear-off line.

4. A packaging structure for an ink tank as claimed in claim 2, wherein the atmosphere communicating port seal member and the covering member are bonded together at least at one part with a predetermined bonding strength.

5. A packaging structure for an ink tank as claimed in claim 4, wherein the predetermined bonding strength is greater than a breakage strength of the easy-breakage region of the covering member.

6. A packaging structure for an ink tank as claimed in claim 1, wherein the atmosphere communicating port seal member comprises a pull portion extending from the covering member and having a mark to be recognized as a portion to be picked up by fingers.

7. A packaging structure for an ink tank as claimed in claim 1, wherein the covering member has different shrinkage factors between a portion which is positioned so as to correspond to at least the atmosphere communicating port seal member and a remaining portion.

8. A packaging structure for an ink tank as claimed in claim 1, wherein the covering member is translucent, opaque, or partially opaque, so that a portion of the atmosphere communicating port seal member covered with the covering member is difficult to observe or not visible from outside.

9. A packaging structure for an ink tank as claimed in claim 1, wherein the ink supply port is on a first side of the ink tank and an atmosphere communicating groove is on a second and different side of the ink tank, wherein the atmosphere communicating port seal member further seals the atmosphere communicating groove, and wherein an end portion of the atmosphere communicating groove is opened by partial breakage of the covering member with a part of the atmosphere communicating port seal member being removed.

10. A packaging structure for an ink tank as claimed in claim 9, wherein the atmosphere communicating port seal member is formed with a slit, the slit not extending across a portion of the atmosphere communicating port seal member facing the atmosphere communicating groove, for easily breaking a portion of the atmosphere communicating port seal member to be removed first.

11. A packaging structure for an ink tank as claimed in claim 10, wherein the slit is formed at an edge portion of the atmosphere communicating port seal member.

12. A packaging structure for an ink tank as claimed in claim 10, wherein a first slit is formed on one edge portion of the atmosphere communicating port seal member as one formed inwardly from a first edge thereof, while a second slit is formed on a second edge portion of the atmosphere communicating port seal member as one formed outwardly from an inner side thereof and then at least extends over the covering member in a direction along the first edge of the atmosphere communicating port seal member.

13. A packaging structure for an ink tank as claimed in claim 1, wherein the covering member is a full-shaped member having a unidirectional easily breakable property.

14. A packaging structure for an ink tank as claimed in claim 13, wherein the covering member comprises an easy-breakage starting portion adjacent the atmosphere communicating port and a pull portion extended therefrom.

15. A packaging structure for an ink tank as claimed in claim 14, wherein the atmosphere communicating port is opened before the ink supply port by partial breakage from an easy-breakage starting portion of the covering member with the atmosphere communicating port seal member being removed.

16. A packaging structure for an ink tank as claimed in claim 15, wherein the atmosphere communicating port seal member comprises the pull portion extending from the covering member, while the covering member has the easy-breakage starting portion formed on at least a position corresponding to an edge portion of the atmosphere communicating port seal member.

17. A packaging structure for an ink tank as claimed in claim 16, wherein the easy-breakage starting portion is comprised by a notch formed on an edge of the covering member.

18. A packaging structure for an ink tank as claimed in claim 15, wherein the covering member is a heat shrinkable film having a uniaxial easily breakable property.

19. A packaging structure for an ink tank as claimed in claim 18, wherein a direction of an easily breakable axis of the covering member is arranged parallel to a direction of peeling the atmosphere communicating port seal member.

20. A packaging structure for an ink tank as claimed in claim 18, wherein the covering member has different shrinkage factors with respect to an axis parallel to a direction of peeling the atmosphere communicating port seal member and with respect to an axis perpendicular to the direction of peeling the atmosphere communication port seal member, respectively.

21. A packaging structure for an ink tank as claimed in claim 20, wherein the shrinkage factors of the covering member satisfy a relationship represented by: $Y>X$, where Y denotes a shrinkage factor of the covering member with respect to the axis perpendicular to the direction of peeling the atmosphere communication port seal member, and X denotes a shrinkage factor of the covering member with respect to the axis parallel to the direction of peeling the atmosphere communicating port seal member.

22. A packaging structure for an ink tank as claimed in claim 15, wherein at least a part of the covering member is provided as an opaque portion and at least the ink supply port seal member is concealed by the opaque portion.

23. An ink tank packaged with a packaging structure according to any one of claims 1, 2 or 3 to 22, the ink tank for storing ink to be supplied to an ink-jet head.

* * * * *

UNITED STATES PATENT AND TRADEMARK OFFICE

CERTIFICATE OF CORRECTION

PATENT NO. : 6,276,786 B1
DATED : August 21, 2001
INVENTOR(S) : Eida et al.

It is certified that error appears in the above-identified patent and that said Letters Patent is hereby corrected as shown below:

Title page,
Item [56], References Cited, Foreign Patent Documents, “07076367” should read -- 07-76367 --.

Column 3,
Line 37, “port;and” should read -- port; and --.

Column 9,
Line 8, “proportionate” should read -- proportionately --;
Line 22, “an” should read -- the --; and
Line 23, “amount:” should read -- amount --.

Column 12,
Line 59, “31"” should read -- 3" --.

Column 14,
Line 24, “C.,.” should read -- C, --.

Column 22,
Line 62, “member” should read -- number, --.

Signed and Sealed this

Second Day of July, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,276,786 B1
DATED : August 21, 2001
INVENTOR(S) : Eida et al.

It is certified that error appears in the above-identified patent and that said Letters Patent is hereby corrected as shown below:

Title page,
Item [75], Inventors, "Kenji Ookawara, Machida" should read -- Kenji Ohkawara, Machida --.

Signed and Sealed this

Twenty-fourth Day of December, 2002

JAMES E. ROGAN
*Director of the United States Patent and Trademark Office*